US006176485B1

(12) United States Patent
Wingate

(10) Patent No.: US 6,176,485 B1
(45) Date of Patent: Jan. 23, 2001

(54) APPARATUS FOR DIVERTING A CONTINUOUS STREAM OF FLAT PRODUCTS TO ALTERNATE PATHS

(75) Inventor: Mark Anthony Wingate, Rochester, NH (US)

(73) Assignee: Heidelberger Druckmaschinen AG, Heidelberg (DE)

( * ) Notice: Under 35 U.S.C. 154(b), the term of this patent shall be extended for 0 days.

(21) Appl. No.: 09/285,685

(22) Filed: Apr. 5, 1999

(51) Int. Cl.[7] ..... B65H 39/10; B65H 29/54
(52) U.S. Cl. ..... 271/303; 271/305
(58) Field of Search ..... 271/303, 305

(56) References Cited

U.S. PATENT DOCUMENTS

| | | | | |
|---|---|---|---|---|
| 4,486,015 | * | 12/1984 | Takanashi | 271/305 X |
| 5,226,547 | * | 7/1993 | Malatesta | 209/657 X |
| 5,293,797 | | 3/1994 | Spalding et al. . | |
| 5,467,976 | | 11/1995 | Doucet . | |
| 5,607,146 | | 3/1997 | Novick et al. . | |
| 5,702,100 | | 12/1997 | Novick et al. . | |
| 5,794,931 | * | 8/1998 | Heilman et al. | 271/303 X |

FOREIGN PATENT DOCUMENTS

| | | |
|---|---|---|
| 0254037 | 1/1988 | (EP) . |
| 0444507B1 | 2/1991 | (EP) . |
| 6-100224 | 4/1994 | (JP) . |

* cited by examiner

*Primary Examiner*—Christopher P. Ellis
*Assistant Examiner*—Kenneth W Bower
(74) *Attorney, Agent, or Firm*—Burns, Doane, Swecker & Mathis, L.L.P.

(57) ABSTRACT

The present invention is related to a diverting device for a continuous sequence of flat products travelling in a product travel plane. A first product exit path and a second product exit path emerge both from said product travel plane. An upper set of supply tapes and a lower set of supply tapes each comprise actuatable diverter guide members, respectively. The diverter guide members, form upper and lower diverting planes, respectively, with exit tapes upon movement of the diverter guide members about respective axes.

19 Claims, 6 Drawing Sheets

APPARATUS FOR DIVERTING A CONTINUOUS STREAM OF FLAT PRODUCTS TO ALTERNATE PATHS

BACKGROUND OF THE INVENTION

The present invention is related to an apparatus for diverting a continuous ingoing stream of flat products such as sheets or signatures to be divided into alternate outgoing paths for further processing thereof.

BACKGROUND INFORMATION

EP 0 444 507 B1 is related to a controllable diverter in a paper transport device, in particular a web-fed rotary printing machine. A diverter segment is provided having an appropriate sequence, the diverter segment itself can be pivoted back and forth in signature cycle for splitting a continuous stream of signatures into two part streams, where the signatures are supplied to the diverter and guided away therefrom by means of conveyor belts, having a diverter segment. The guide face has a ramp face for the signature which, in a limit position of the diverter segment, forms an acute angle $\alpha$, $\beta$ with the conveyor belt. A first end of the diverter segment facing the entry of the signature has a thickness which is equal to or a multiple of the thickness of the second end.

U.S. Pat. No. 5,293,797 discloses a multiple point delivery apparatus for separating of sheet-like elements.

A sheet diverter apparatus diverts sheets into alternate paths by guiding the leading portion of each sheet through a gap in a horizontal conveyor into alternate diverter belt conveyor units where the sheet is firmly grasp for transfer. The one conveyor unit is a horizontal unit, having a top belt conveyor and a bottom belt conveyor, one of which is offset downstream to form a diverting gap. A diverter is located to successively rotate through the gap and divert the alternate sheet into the angulated conveyor unit. In an upwardly angulated conveyor the horizontal moving sheet is supported by the bottom conveyor belt of the horizontal unit. In a downward angulated conveyor unit the length of the gap is selected to maintain sheet flow across a gap in the plane of the sheet. The top conveyor or the horizontal unit assists the support of the horizontal sheet. The linear or surface speed of the diverter cam is greater than the linear speed of the sheet. The cam surface is constructed with a low friction surface such as provided by a low friction plastic coating.

JP-Hei 6-100224 discloses a pinless type folder having a distributing device for without pins, whereby sheets or folded sheets kept by means of a cutting cylinder attached to the folding apparatus of a rotary printing press are distributed at the end of the first pair of transport tapes for the sheets or folded sheets, located below the cutting cylinder and running in the same direction. A distribution device and a guiding element consist of two pairs. A discharge roller is disposed at the end of the first transport tapes for folded sheets, said discharge roller making a swinging motion in accordance with the number of sheets to be distributed.

EP 0 254 037 A2 discloses a sheet diverter for signature collation and method thereof. A sheet diverter, adapted for cooperative association with a cutter in a pinless folder assembly for a high speed printing press, wherein a ribbon is cut into a plurality of signatures destined for serially deflected parallel collation from a diverter path through the sheet diverter to a desired one of a plurality of collation path comprises an oscillating diverter guide member. This oscillating diverter guide member reciprocates in a diverter plane having a component generally normal to the diverter path of a signature through the guide member, for directing the lateral disposition of the leading edge of the signature into engagement with a diverter member separating a plurality of collation path. Each path has a throat for receiving a selected signature and merging to a confined course for guiding it, the diverter member including a diversion surface disposed in each of the throats lying at a diversion angle respecting the travel of the signatures from the oscillating guide member. The diverter member directs the leading edge of the signature and controls its course through the throat into the collation path.

U.S. Pat. No. 5,607,146 discloses a mechanism for diverting of products in a folding apparatus. A device for diverting signatures into pockets of at least two slow-down devices is provided. The device includes a set of high-speed tapes arranged downstream of a pair of cutting cylinders. A set of diverting belts comprises raised surface portions and non-raised surface portions. The set of high-speed tapes is assigned to the diverting belts to ride on the raised and non-raised surface portions thereof, thus, periodically altering a signature conveying path of signatures.

U.S. Pat. No. 5,702,100 discloses a mechanism for diverting signatures by the rotation of surfaces. A diverter mechanism for signatures in a folding apparatus is provided including a set of high-speed tapes for conveying signatures in a conveying plane toward delivery stations. Rotating diverting elements are integrated into the path of the high-speed tapes. Each of the diverting elements has at least two rotatably mounted guiding surfaces that alter the diverting direction of signatures upon rotation of the diverting elements.

U.S. Pat. No. 5,467,976 discloses a device including a diverting mechanism for changing the conveying direction of products in a folder. An apparatus includes a diverting device for changing the transport direction of products in a folder. Products travelling horizontal transport path on a first conveying tape are diverted by the diverting device onto a second conveying tape which forms an inclined transport path. The diverting device includes diverting tapes which are diverted from a position along the horizontal transport path to a position along the inclined transport path by levers which are swivelably mounted on stationary axes.

SUMMARY OF THE INVENTION

In addition to the known embodiments mentioned above some diverters known in the art use fingers or tines that oppose product travel which can impale loose products and cause a jam, especially when said signatures are of very thin paper stock and are delivered at high speeds.

Those diverters come along with a significant potential for product damaging and are prone to cause jams. The sensitivity of such diverters to jams is highly dependent on accuracy of presetting operations. Further said diverters have a limited access for maintenance and trouble shooting.

According to the present invention a diverting device for a continuous sequence of flat products includes:

- a product travel plane,
- a first product exit path and a second product exit path emerging from said product travel plane,
- an upper set of tapes and a lower set of tapes each having actuatable guide members assigned thereto,
- said guide members, respectively, forming an upper and lower diverting planes, respectively, with exit tapes upon movement about respective axes, respectively.

The present invention comes along with numerous advantages such as the diverter guide members bridging the distance between the supply tape exit nip and the exit tape entrance nip. This distance is minimized to maintain positive control over the signature as long as possible. Thus, the potential for product damage is significantly reduced. The construction of the diverter designed as two relatively movable pieces, one above and one below the signatures allows for easy access to the product travel plane. With this configuration the signature leaving the supply tape out-going nip is deflected by said diverter guide to lead the signature's leading edge for instance into the lower exit tape path or, on the alternative, the diverter guides the next signature's lead edge into the upper exit path. This function can be performed alternatingly. The supply tapes separate after the diverter guides, the upper supply tapes form the top of the upper exit tape path, and the bottom supply tapes join the lower exit tapes and form the lower exit tape path. The supply tape supports the side of the product opposite the diverter guide between the supply tape out-going nip and the exit tape in-going nip. The diverted products are sandwiched between supply tapes and diverter guides before entering the exit tapes. The supply tapes form "dynamic guides" and aid transporting the products.

According to further embodiments of the present invention, said diverter guide members respectively are integrated into said upper and lower set of supply tapes. In the diverter guide members retracted position said guiding members do not interfere into the respective signature's travel path. Further, said diverter guide members are assigned to an intermediate tape pulley shaft of said upper and lower set of supply tapes, thus a rotation of said intermediate tape pulley shaft about the respective tape pulley shaft axis results into a rotation of the respective guide member. Said upper set of supply tapes is mounted relatively movable towards an upper exit tape, for instance about a first tape roll center to allow for swinging open the entire upper set of tapes and diverting guides for easy access to the respective product travel plane.

Said lower set of supply tapes likewise can be movable about the first tape roll center or some other pivot point, said upper set of supply tapes and said lower set of supply tapes respectively, each forming a nip with upper and lower exit tape arrangements. In a respective upper transport position said actuated diverter guide members, said exit tapes, and said upper set of supply tapes form a travel plane for said signatures, forming a first product exit path. Likewise, when said guide members are rotated into the opposite direction, said lower exit tapes and said lower set of supply tapes form a lower product transport position.

To ease the product's respective travel said diverter guide members are provided with concave or flat guides surfaces which can be made of a low friction and/or high wear resistance material such as green plastic (UHMW). Advantageously, said concave or flat surface portions assigned to said diverter guide members are oriented towards said product travel plane. In both the lower transport position and the upper transport position said diverter guide members form a part of a signature transport plane allowing for travel of the respective diverted products, either in said first product exit path or in said second product exit path. For actuation of said diverters, either in the upper diverting position or in the lower diverting position said diverter guide members are actuated by actuating rollers, which in turn may cooperate with designs such as eccentric cams or may have direct high torque drives which can be switched at a very high frequency between two positions, the upper and the lower of the respective diverter guide members. Said diverting device according to the present invention can be very useful in applications such as folder apparatuses. For instance the diverter could be silenced to allow all signature's to run straight (Tabloid Format) into the lower, i.e. the second product exit path or all the products could go to the upper exit tape path.

BRIEF DESCRIPTION OF THE DRAWINGS

The novel features which are considered as characteristic for the invention are set forth in particular in the appended claims. The invention itself, however, both as to its construction and its method of operation together with additional objects and advantages thereof, will be best understood from the following description embodiment when read in connection with the accompanying drawings, in which:

DESCRIPTION OF PREFERRED EMBODIMENTS

Figure 1:
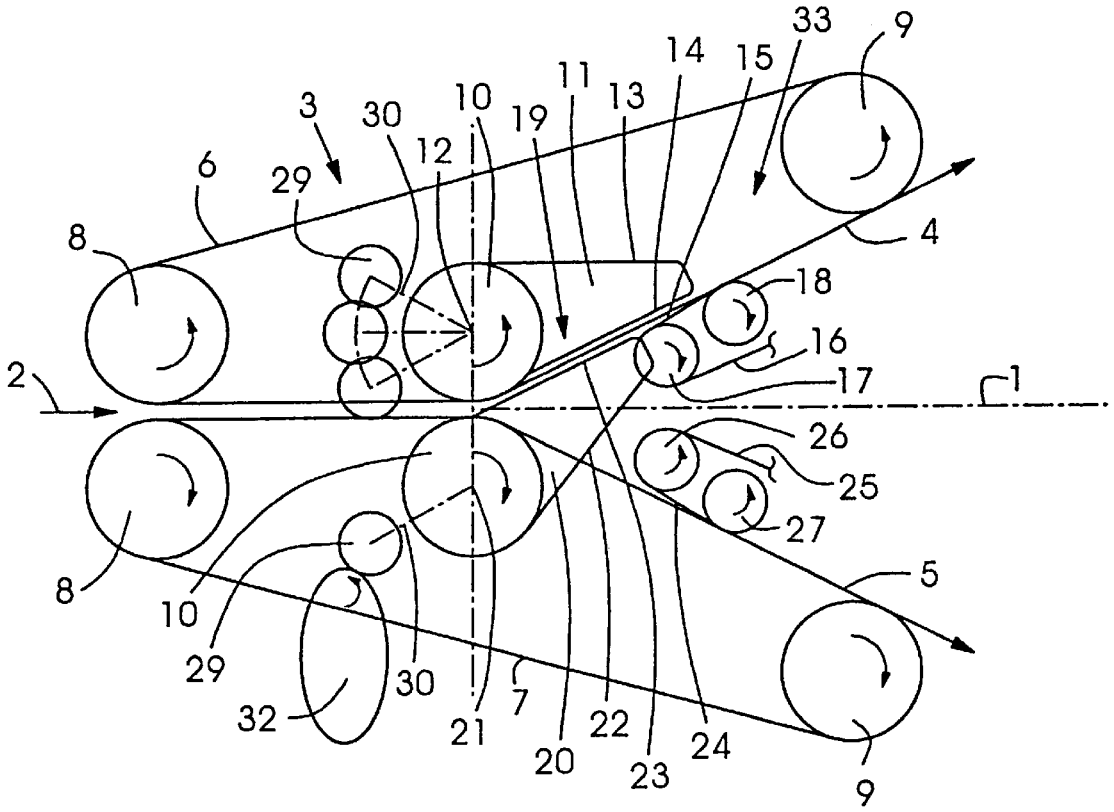
FIG. 1 shows a diverter assembly, the diverter guide members according to the present invention diverting products into a first upper product exit path.

FIG. 1 shows a diverter assembly 3 having two diverter guide members 13, 22 which are moved both into an upward position to allow for diverting products into an first upper product exit path 4. On both sides about the product travel plane 1 exit tape paths do not need to be symmetrical about the entry plane 2 or travel plane 1 an upper set of supply tapes 6 and a lower set of supply tapes 7, is arranged. Said upper and lower set of supply tapes 6, 7, respectively, move about an entry tape roll 8, an exit tape roll 9, and said supply tapes 6, 7 respectively are deflected by an intermediate tape pulley shaft 10. To allow for easy access to the upper product travel plane 4, said upper set of supply tapes 6 can be swung away in a rotational movement about its first entry tape roll 8 or some other pivot point. The swinging open movement can be facilitated by assigning an air cylinder to said upper set of supply tapes 6 which facilitates the rotational movement. In the alternative, it is conceivable as well to swing away said lower set of supply tapes 7 into a downward direction, to allow for access to the product travel plane 5 from the bottom side of said diverter assembly 3 to allow access for maintenance or cleaning.

Said set of supply tapes 6, 7 both said upper and said lower set of supply tapes, respectively, move about said tape rolls 8, 9 or tape pulleys 10. Said tapes can be spaced adjacent to one another across the width of said diverter assembly 3, forming free spaces between said single supply tapes, into which said diverter guide members 13, 22 mount and dive upon upwardly or downwardly directed movement Assigned to said upper product travel plane 4 are a pair of upper exit tapes 16 moving about tape roller 17, 18, respectively, forming said upper product travel plane 4 when joined with upper supply tape 6. Further, lower exit tapes 25 are arranged to form lower said product travel plane 5, cooperating with said lower set of supply tapes 7. Said exit tapes 16, 25, respectively, move about tape rolls 17, 18 or 26, 27 respectively, having a smaller diameter as compared to said tape rolls 8, 9 or tape pulleys 10 of said upper and lower set of supply tapes 6, 7, respectively exit tapes 16, 25 also move about tape roll 9. In the upper transport position, i.e. the engaged position of diverter guide 13 into said upper set of supply tapes into said product travel plane 1, said upper set of supply tapes 6 forms an upper nip 15 with said exit tapes 16. In FIG. 1, for instance, in the position, i. e. the upper transport position 33, both diverter guide members 13, 22 adopt an upper diverting plane 19 is defined by said surface portions 14, 23, respectively, of said guide members 13, 22 being inline with the upper said of supply tapes 6 and said exit tape 16 forming an upper nip 15 with said upper set of tapes 6. The product is transported between lower guide 22 and upper supply tape 6. In the upper position (FIG. 1) the upper guide does not contact the products. The upper supply tape acts as a "dynamic guide".

Said surface portions 14, 23, respectively provided on those portions of said diverter guide members 13, 22 oriented towards said product travel plane 1 may include concave (or flat) portions to allow for low friction and smooth conveying of flat floppy articles such as folded products. Said portions having an concave profile tend to steer or guide said flat articles toward the exit tape nip 15. Said surface portions having a concave or flat profile provided on said diverter guide members 13, 22, respectively may comprise a high wear resistance material such as green plastic (UHMW) yielding a low friction coefficient upon signature transport.

Said lower set of tapes 7 rotates about tape rolls 8, 9, and tape pulleys 10. To said intermediate tape pulleys shaft 10 a diverter guide member 22 is attached cooperating with said diverter guide member 11 provided on the intermediate tape pulley shaft 10 of said upper set of supply tapes 6.

As can be derived from FIG. 1 in the upper transport position 33 said lower diverter guide member 22 has moved through said product travel plane 1 causing said lower set of supply tapes 7 to dive into recess portions 37 provided between said lower diverter guide members 22. The same is true between said upper diverter guide members 13, having recesses 36 into which said set of tapes 6 dive upon downward directed movement of said upper diverter guide member 13 about said axis 12.

As shown in FIG. 1, said diverter guide members 13, 22, respectively, moved in said upper transport position 33, form an entry plane 19 for the products into an upper nip 15, formed by said upper set of supply tapes 6 and said exit tape 16, conveying said products in said first product exit path 4. The actuation of said diverter guide members 13, 22, respectively, can be achieved either by actuating rollers 29, linked by a lever 30 or the like to said centres of rotation 12, 21 of said diverter guide members 13, 22 or by high torque motors. Said actuating rollers 29, assigned, to said upper diverter guide member 13 and said lower diverter guide member 22 cooperate with an eccentric cam 32 as shown in the drawing. Said eccentric cams 32 act upon said actuating rollers 29 to impose a rotational movement of said guide members 13, 22 about the respective axis 12, 21, respectively. Said eccentric cams 32 may have a hardened surface and are mounted for rotational movement about respective axes as shown by the arrow given in FIG. 1.

In FIG. 1, said upper set of supply tapes 6 shows an actuating roller 29 given in various stages thereof. Said actuating roller 29 shown here cooperates with eccentric cams 32 as shown in FIG. 1 assigned to said actuating roller 29 of said lower diverter guide member 22. Said actuating rollers 29 may be replaced by actuating motors directly assigned to said axes 12, 21 about which said diverter guide members 13, 22 move in upward or downward direction. Said actuating motors may be high torque motors to give an example.

Within said diverter assembly 3 said diverter guide members 13, 22, respectively are placed to bridge the distance in said product travel plane 1 between the exit nips of said supply tapes 6, 7 between said intermediate tape pulleys 10 and said respective upper and lower nips 15, 24 into exit tapes, respectively. Thus, positive control on said products to be conveyed is maintained by the overlap closing up gaps as the products are deflected into alternating exit tape path 4, 5 respectively. In FIG. 1 the angle between said alternate tape path's 4, 5, respectively is shallow, thus allowing for lower products product stresses and less product deflection upon diverting said products. Said tapes of said upper and lower set of supply tapes 6, 7, respectively are speed matched, thus no speed differentials occur between said tapes and top and bottom of the products to be conveyed. Also, supply tapes 6, 7 are speed-matched to exit tapes 16, 25.

Figure 2:
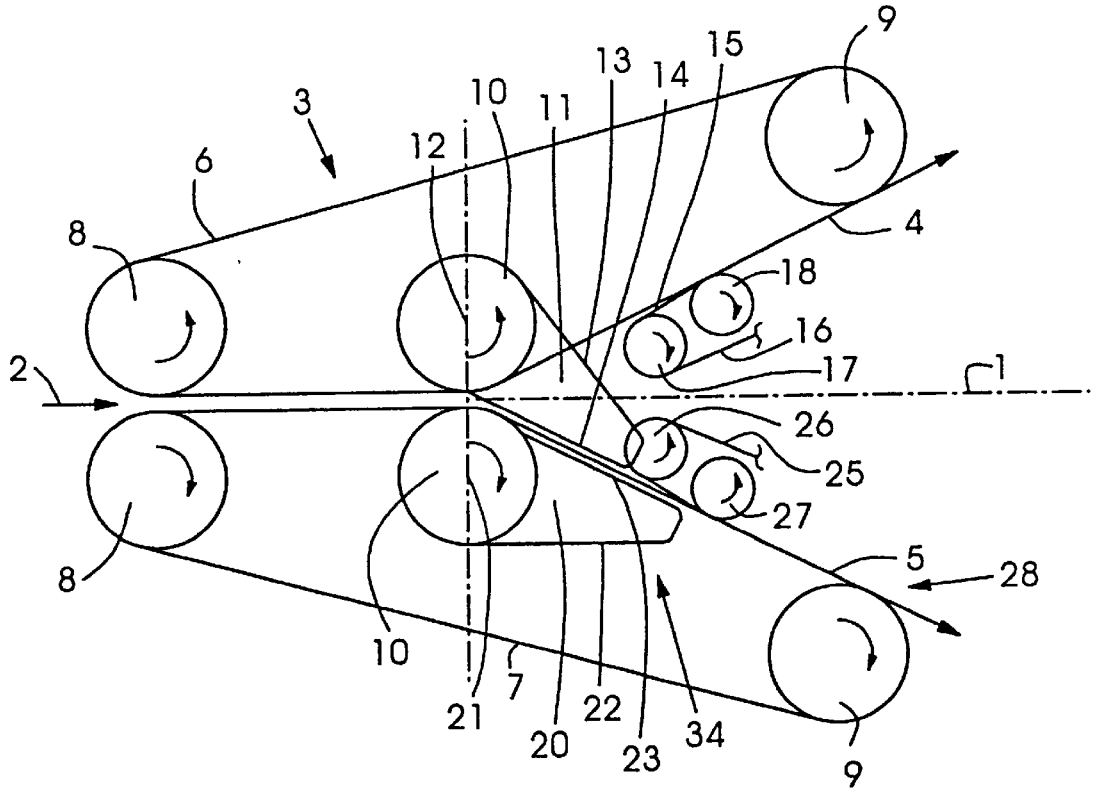
FIG. 2 shows said diverter guide members according to the present invention actuated into a second lower product exit path.

FIG. 2 shows diverter guide members according to the present invention actuated in a second product exit path.

As previously described, said diverter guide members 13, 22 are rotated into a lower transport position 34 conveying products into a lower diverting plane 28 following a second product exit path 5. In this position only the upper diverter guide member 13 acts upon said product to be diverted to deflect them into said downwardly extending diverting plane 28. Upon an alternating movement of said diverter guide members 13, 22, respectively, said guide members may move up and down and deflect every other product into the first and second product exit path 4, 5 respectively. Thus, an alternating diverting of a continuous stream of products is deflected into two different conveying paths 4, 5, respectively. To have the products to be conveyed into said second product exit path 5, said diverter guide members 13, 22, respectively could be silenced in the lower (tabloid) position 34 by sliding the eccentric cam 32 axially or engaging a cam segment to mask the cam action or freezing the motor in a known position. The same holds true for diverting all the products to the upper product tape path.

Figure 3:
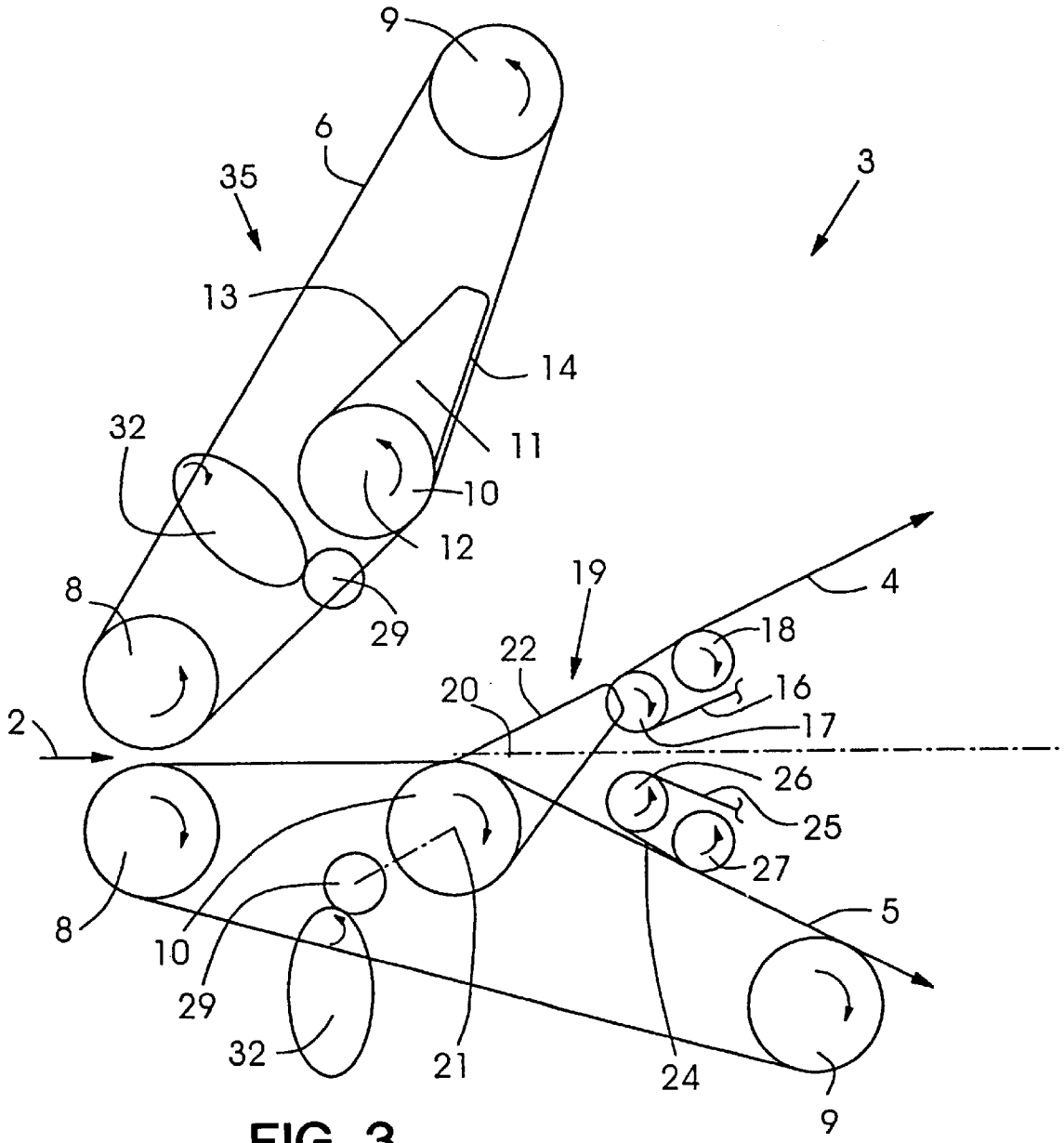
FIG. 3 shows the respective upper set of supply tapes to be moved in a swung-open position to allow for easy access to the signature travel plane and the first product exit path.

FIG. 3 shows the respective upper set of tapes to be moved in a swung-off position to allow for easy access to the signature travel plane and the first product exit path.

In the access position 35 given here, said upper set of supply tapes 6 is swung open to allow for easy access to the signature travel plane 1 for maintenance or cleaning. The entire upper set of supply tapes 6 can be swung open about tape roll 8 or some other pivot point. Consequently, said intermediate tape pulley shaft 10 to which said upper diverter guide member 13 is assigned will move out of the product travel plane 1. Said actuating roller 29 likewise would lift-off from a center mounted eccentric cam 32, when either said upper set of supply tapes 6 would swing open or said lower set of supply tapes 7 will swing downwards out of the product travel plane. Upon swinging back into the product travel plane 1, said upper or lower set of supply tapes 6, 7 would swing into the product travel plane 1 again and move against stops. The actuating rollers 29 contact the eccentric cam 32 again, which may be mounted on subassembly side rails to give an example. If the cam 32 is mounted on sub-assembly side rails it will move in an upward direction with supply tapes 6 and actuating roller 29 would not separate from the cam. If there is only one cam that is centrally mounted, then both actuating rollers 29 would contact this cam. When upper supply tapes 6 swing upwards, to open the system, the actuating roller 26 would separate from the central cam and contact the cam again when closed. The same would apply to lower supply tapes 7.

Although shown here in the swung open position for the respective upper set of tapes, said lower set of tapes 7 may be swung away likewise out of said product travel plane 1.

Figure 4:
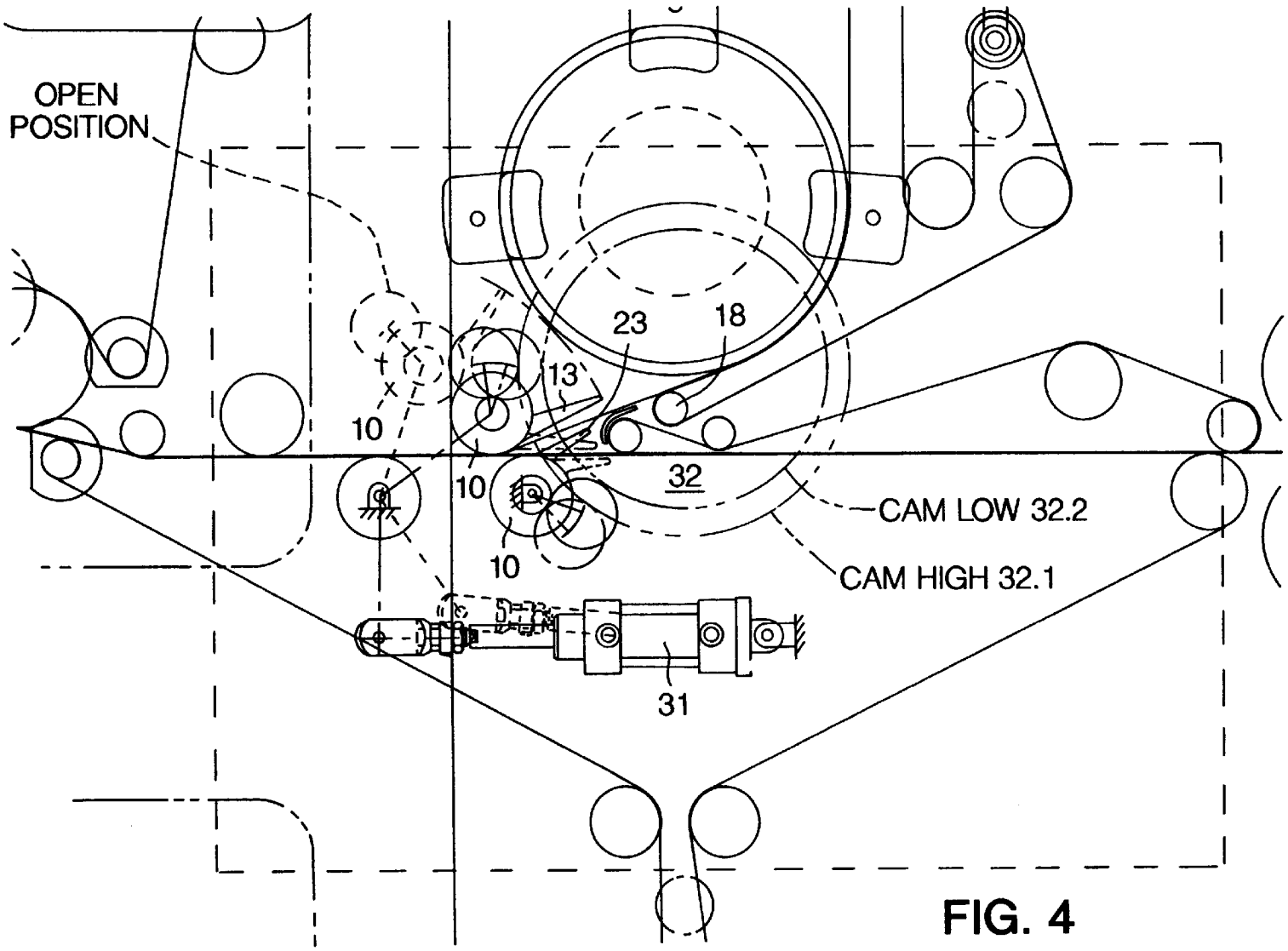
FIG. 4 is a side view of a folder's diverting section.

FIG. 4 shows a side view of a diverter section of a folder apparatus.

In this view a cam 32 is shown having a high cam section 32.1 and a low cam section 32.2. Said respective cam sections 32.1, 32.2, respectively, act upon actuating rollers actuating said diverter guide members 13, 22, switching them either into an upward path or a downward directed signature transport path. Said actuating rollers transmit an actuating movement to respective pulley shafts 10 to which said diverter guide members 13, 22 are assigned. Below said diverter section an actuating unit 31 is shown, moving said upper set of supply tapes 6 into its swung-open position 35 allowing access to said diverting section for maintenance and cleaning purposes according to FIG. 3. The actuating movement of said actuating unit 31 is shown by the representation of said piston rod of said actuating unit 31 and said intermediate pulley shaft given in dashed-lines in FIG. 4.

Figure 5:
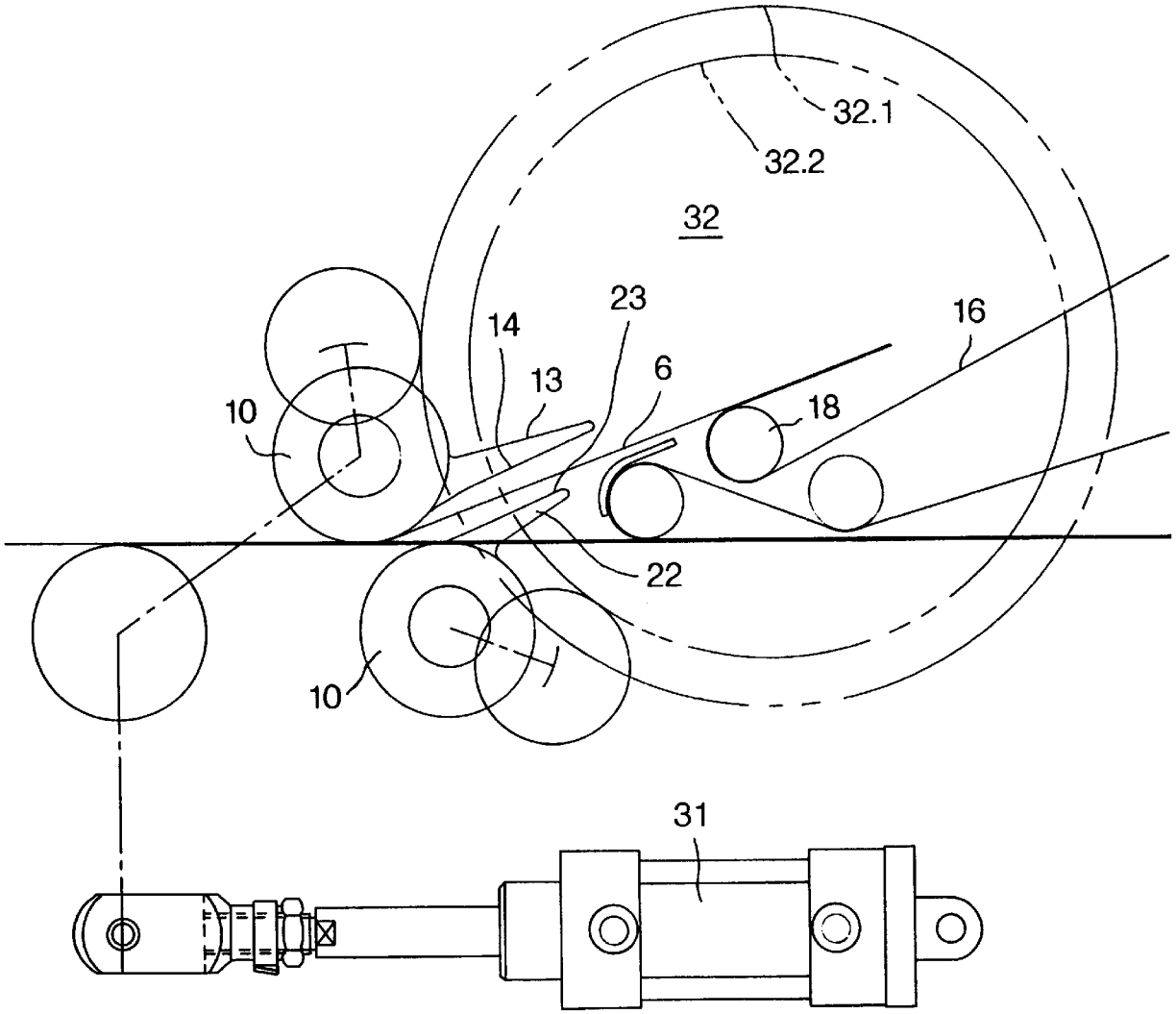
FIG. 5 is a view of a folder's diverting section in a larger scale, and FIG. 6 in general shows a folder apparatus having a diverting device integrated into the signature travel path.

FIG. 5 shows said diverting section of a folder in an enlarged scale, said diverter guide members 13, 22, respectively swung open matching an upper first product exit path. Said upper product path extends between an upper set of supplied tapes and said upper exit tape 16, respectively. The actuating roller assigned to the respective upper diverter guide member 13 travels upon the high cam section 32.1. The respective lower actuating roller assigned to said lower diverter guide member 22 travels upon said lower cam section 32.2.

Figure 6:
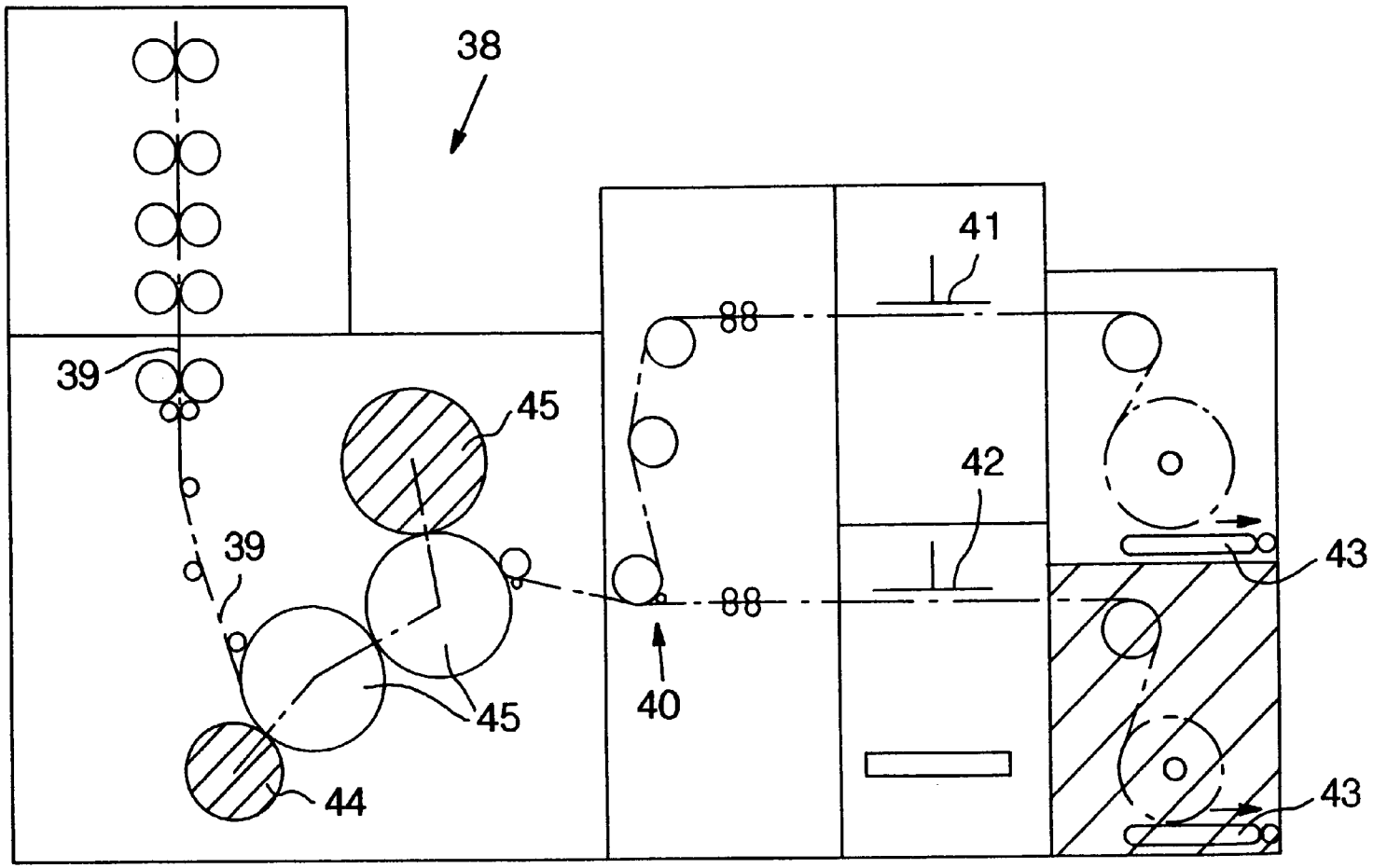

FIG. 6 schematically shows a general side view of a folder apparatus.

Said folder 38 includes a plurality of folding cylinders 45 applying a delta or a double parallel cross-folds on signatures to be conveyed. Said web path 39 extends to said folding cylinders 45 passing an optional stitcher 44. A diverter 40 is arranged behind said cross-folding section allowing for diverting of said folded signatures into an upper or a lower quarterfold device 41, 42, respectively via said first product exit path 4 and said lower product exit path 5. After said quarterfold arrangements 41, 42, respectively, delivery units 43 are arranged allowing for further transfer of said folded signatures.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What I claim is:

1. Diverting device for a continuous sequence of flat products, including:

a product travel plane, a first product exit paths and a second product exit path emerging from said product travel plane; and an upper set of supply tapes, a lower set of supply tapes, and at least two actuatable diverter guide members, wherein said diverter guide members form upper and lower diverting planes with upper and lower exit tapes upon movement of the diverter guide members about respective axes, such that a flat product passes between the two diverter guide members to either of said upper and lower diverting planes.

2. Diverting device according to claim 1, wherein said diverter guide members are mounted within the spaces formed by each said upper and lower set of supply tapes.

3. Diverting device according to claim 1, wherein said diverter guide members are mounted to intermediate tape pulley shafts of said upper and lower sets of supply tapes.

4. Diverting device according to claim 1, wherein said upper set of supply tapes is mounted relatively movable towards or away from said upper exit tape.

5. Diverting device according to claim 1, wherein said lower set of supply tapes is mounted relatively movable towards or away from said lower exit tape.

6. Diverting device according to claim 4, wherein said upper set of supply tapes form a nip with said upper exit tape.

7. Diverting device according to claim 5, wherein said lower set of supply tapes form a nip with said lower exit tape.

8. Diverting device according to claim 4, wherein said upper set of supply tapes is movably mounted about a pivot point to allow swinging towards or away from said upper exit tape.

9. Diverting device according to claim 4, wherein said diverter guide members, said upper exit tape and said upper set of supply tapes form an upper transport position.

10. Diverting device according to claim 5, wherein said diverter guide members, said lower exit tape and, said lower set of supply tapes form a lower transport position.

11. Diverting device according to claim 1, wherein said diverter guide members each comprise either a concave surface portion or a flat surface portion.

12. Diverting device according to claim 11, wherein said concave or flat surface portion is oriented towards said product travel plane.

13. Diverting device according to claim 9, wherein said diverter guide members in said upper transport position form an entry plane towards said first product exit path.

14. Diverting device according to claim 9, wherein said diverter guide members in said lower transport position form an entry plane aligned with said second product exit path.

15. Diverting device according to claim 1, wherein said diverter guide members, respectively, are actuated by an actuating roller co-operating with an eccentric cam.

16. Folding apparatus comprising a diverting device for a continuous sequence of flat products, including:

a product travel plane;

a first product exit path and a second product exit path emerging from said product travel plane; and an upper set of supply tapes, a lower set of supply tapes and at least two actuatable diverter guide members, wherein said diverter guide members form upper and lower diverting planes with upper and lower exit tapes upon movement of the diverter guide members about respective axes such that a flat product passes between the two diverter guide members to either of said upper and lower diverting planes.

17. Diverting device according to claim 1, wherein the two diverter guide members comprise an upper diverter guide member and a lower diverter guide member.

18. Diverting device according to claim 17, wherein said flat product is passed between the two diverter guide members while in contact with only said upper and lower sets of supply tapes, said lower diverter guide member, and said lower exit tapes.

19. Diverting device according to claim 17, wherein said flat product is passed between the two diverter guide members while in contact with only said upper and lower set of supply tapes, said upper diverter guide member, and said upper exit tapes.

* * * * *